United States Patent [19]

Tabata

[11] Patent Number: 4,887,515

[45] Date of Patent: Dec. 19, 1989

[54] HYDRAULIC CYLINDER APPARATUS

[75] Inventor: Masaaki Tabata, Susono, Japan

[73] Assignee: Toyota Jidosha Kabushiki Kaisha, Aichi, Japan

[21] Appl. No.: 247,374

[22] Filed: Sep. 21, 1988

[30] Foreign Application Priority Data

Sep. 29, 1987 [JP] Japan ..... 62-242680

[51] Int. Cl.[4] ..... F01B 31/00; F15B 21/00

[52] U.S. Cl. ..... 92/80; 92/82; 92/86; 92/107; 92/111; 188/315; 188/322.14; 267/64.15; 267/64.16

[58] Field of Search ..... 92/86, 52, 80, 82, 107, 92/111, 112; 188/322.14, 315; 267/64.15, 64.16

[56] References Cited

U.S. PATENT DOCUMENTS

| | | | |
|---|---|---|---|
| 3,293,994 | 12/1966 | Napolitano | 92/82 X |
| 3,972,396 | 8/1976 | Bochnak | 92/86 X |
| 4,463,663 | 8/1984 | Hanson, Jr. et al. | 92/80 |
| 4,597,322 | 7/1986 | Garnjost et al. | 92/86 X |

FOREIGN PATENT DOCUMENTS

| | | | |
|---|---|---|---|
| 54-55913 | 5/1979 | Japan . | |
| 60-67404 | 5/1985 | Japan . | |
| 61-12125 | 4/1986 | Japan . | |
| 2024946 | 1/1980 | United Kingdom | 92/111 |

*Primary Examiner*—Robert E. Garrett
*Assistant Examiner*—Mark A. Williamson
*Attorney, Agent, or Firm*—Oliff & Berridge

[57] ABSTRACT

A hydraulic cylinder apparatus is used by connecting an external pressure source with extension and contraction-side liquid chambers defined by a cylinder, a piston sliding in the cylinder and a piston rod integral with the piston. The apparatus includes seal members provided with the extension and contraction-side liquid chambers and formed to enable liquid to leak through clearances between the seal members and the parts disposed opposite to the seal members. Liquid leaked from the extension and contraction-side liquid chambers is received by a receiving chamber which is formed so as to change its volume with the movement of the piston rod.

4 Claims, 4 Drawing Sheets

HYDRAULIC CYLINDER APPARATUS

BACKGROUND OF THE INVENTION

1. Field of the Invention:

This invention relates to a hydraulic cylinder apparatus and, more particularly, to a hydraulic cylinder apparatus suited as a precision servo.

2. Description of the Prior Art:

An actuator as a hydraulic cylinder apparatus is disclosed in Japanese patent publication No. 61-12125, for example. This actuator is provided with a cylinder having outside and inside cylinder sections extending coaxially and subjected to contraction pressure in the outside cylinder section and extension pressure in the inside cylinder section and a cylindrical piston rod having one end provided with a piston sliding in the outside cylinder section and the other end closed by a plunger. Since the pressure receiving area of the piston is formed equally to that of the plunger, the force generated by the piston at the time of contraction equals that generated by the plunger at the time of extension when equal fluid pressures act on the piston and plunger respectively. As a result, control quantity for controlling loads by means of the piston and plunger does not need to be changed to improve the operating property.

In the actuator according to the proposal as noted above, seal members disposed between the outside cylinder section and the piston and between the inside cylinder section and the piston rod or the like are constituted so as to prevent liquid from leakage, so that frictional force is increased as hydraulic pressure is increased, thus resulting in difficulty in using the actuator as a precision actuator.

The frictional force may be selectively reduced by a hydraulic cylinder apparatus (Japanese Utility Model Public Disclosure (KOKAI) No. 60-67404) which includes a seal member capable of leaking liquid and disposed between a cylinder and a piston therefor recovering leaked oil to a reservoir tank through a switch valve. However, when the reservoir tank is positioned above the cylinder apparatus, for example, a pump or the like for recovering the leaked oil to the reservoir tank is needed and this makes the cylinder apparatus complicated and expensive.

SUMMARY OF THE INVENTION

An object of the present invention is to provide a hydraulic cylinder apparatus which may restrain frictional force from increasing irrespective of the increase of working pressure and which is manufactured economically.

The present invention provides a hydraulic cylinder apparatus including a cylinder, a piston sliding in the cylinder, and a piston rod integral with the piston, an extension-side liquid chamber and a contraction-side liquid chamber being defined by the cylinder, the piston and the piston rod and connected to an external pressure source for use. This hydraulic cylinder apparatus comprises seal members capable of leaking liquid which are associated respectively with said extension and contraction-side liquid chambers, a receiving chamber connected with a reservoir tank for receiving liquid leaked from at least one of said extension and contraction-side liquid chambers and a check valve disposed between the receiving chamber and the reservoir tank to allow liquid to flow from the receiving chamber to the reservoir tank. The receiving chamber is formed so as to change the volume with the movement of the piston rod.

When the cylinder has two partition walls disposed axially at an interval and provided respectively with through holes extending axially, the piston is disposed slidably in the cylinder between both partition walls to partition the interior of the cylinder into the extension-side liquid chamber and the contraction-side liquid chamber. The piston rod integral with the piston extends through the holes bored in the respective partition walls. The seal members are disposed between the respective partition walls and the piston rod and between the cylinder and the piston and formed so as to leak a small amount of liquid the condition of which is referred to as "liquid leakable". Two receiving chambers respectively communicating to the extension- and contraction-side liquid chambers are provided. One of the receiving chambers is connected to the reservoir tank and the check valve is disposed between the reservoir tank and the receiving chamber connected to the reservoir tank.

When the cylinder has a bottom wall and a partition wall which is disposed axially and spaced apart from the bottom wall and provided with a through hole extending axially, first and second pistons are provided. The first piston is disposed slidably in the cylinder between the bottom and partition walls to partition the interior of the cylinder into a first receiving chamber at the bottom wall side which is connected to the reservoir tank and the contraction-side liquid chamber. A seal member is disposed liquid leakably between the cylinder and the first piston. The piston rod integral with the first piston extends through the hole bored in the partition wall and a seal member is disposed liquid leakably between the piston rod and the partition wall. The piston rod has a bore hole extending axially from an end face of the piston. A second fixed piston is inserted into the bore hole of the piston rod so as to make the piston rod slidable. A seal member is disposed liquid leakably between the piston rod and the second piston. The extension-side liquid chamber is defined by the second piston and the piston rod. A second receiving chamber communicates to the contraction-side liquid chamber through the hole bored in the second partition wall. The check valve is disposed between the first receiving chamber and the reservoir tank.

Through each of the clearances between the seal members and parts disposed opposite to the seal members and movably relative thereto takes place liquid leakage. An amount of the liquid leakage in this case may be small to such an extent that it does not damage the original function of extension and contraction when high pressure acts on the extension-side liquid chamber or contraction-side liquid chamber.

The hydraulic cylinder apparatus, for example, is disposed between a suspension arm and a car body so as to actively control vibration in a suspension system of an automobile.

When high pressure is applied to the extension-side liquid chamber or the contraction-side liquid chamber, liquid leaks from a clearance between the seal member and the parts opposed to the seal member to form a film of leaked liquid on the parts, thus resulting in reduction of the coefficient of friction and frictional force.

The leaked liquid enters the receiving chamber and is received therein. Since the receiving chamber is filled with air, the air is compressed by a change in the volume of the chamber caused by the movement of the piston rod to exert pressure to the liquid. When the liquid pressure reaches a predetermined value, the check valve is opened to return the liquid to the reservoir tank.

When high pressure acts on the extension-side liquid chamber or the contraction-side liquid chamber even if the piston rod does not move, liquid leakage takes place and air is compressed by the leaked liquid itself, so that the liquid is subjected to pressure and recovered to the reservoir tank.

So long as the pressure in the receiving chamber does not become higher than the pressure at a downstream side of the check valve, the liquid in the receiving chamber is not recovered to the reservoir tank. This means that the pressure higher than the pressure at the downstream side of the check valve is generated in the receiving chamber, and this pressure may resist the movement of the piston. Since the pressure generated in the receiving chamber is, however, sufficiently small compared with pressure acting on the extension-side liquid chamber and the contraction-side liquid chamber, the resistance of the pressure generated in the receiving chamber against the piston may be actually neglected.

Since the frictional force between the seal member and the movable parts opposed to the seal member is small, the piston rod may be precisely moved to be used as an actuator for a precision servo.

Since a pump is not needed to recover the liquid leaked in the receiving chamber to the reservoir tank, the economical manufacturing of the hydraulic cylinder apparatus may be attained also from this feature.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE EMBODIMENTS

Figure 1:
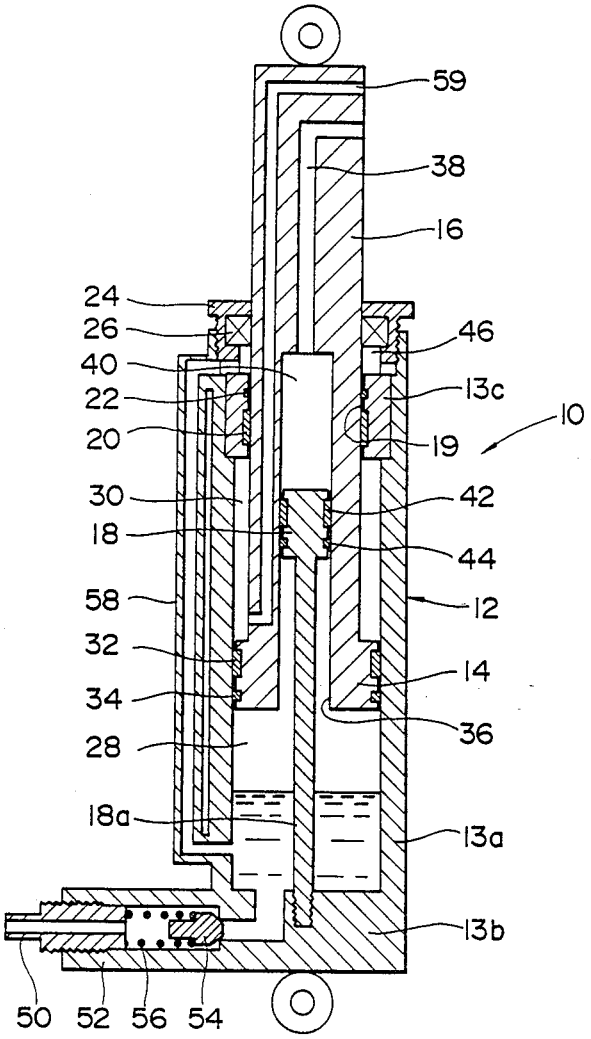
FIG. 1 is a sectional view showing a hydraulic cylinder apparatus.

Referring to FIG. 1, a hydraulic cylinder apparatus 10 comprises a cylinder 12, a first piston 14, a piston rod 16 and a second piston 18.

The cylinder 12 has a cylindrical main body **13*a*, a bottom wall 13*b* integral with the main body 13*a* and a partition wall 13*c* disposed axially and spaced apart from the bottom wall 13*b*. The partition wall 13*c* is provided with a through hole 19 extending axially. In the embodiment shown, the partition wall 13*c* is a cylindrical seal housing, in which a guide 20 and a seal member 22 are attached to an inner peripheral surface. The partition wall 13*c* is inserted into an opening of the main body 13*a* to be fixed in the main body 13*a* by a nut 24 threaded therein. An oil seal 26 is attached to the nut 24**.

The piston 14 is disposed slidably in the main body **13*a* of the cylinder 12 between the bottom wall 13*b* and the partition wall 13*c* to partition the interior of the cylinder 12 into a first receiving chamber 28 at the bottom wall 13*b* side and a contraction-side liquid chamber 30. A guide 32 and a seal member 34 are attached to an outer peripheral surface of the piston 14**.

The piston rod 16 extends through the hole 19 bored in the partition wall **13*c* and is formed on an inner end integrally with the piston 14. The piston rod 16 has a bore hole 36 extending axially from an end face of the piston 14 and a small bore hole 38 communicating to the bore hole 36. The bore hole 38 is opened laterally in a position where it does not interfere with the nut 24 even if the piston rod is extended and contracted. The hole 38** is connected to an external pressure source through a flexible hose.

The piston 18 has a rod **18*a* and is fixed to the bottom wall 13*b* by threading an end of the rod therein. The piston 18 is inserted into the bore hole 36 bored in the piston rod 16 so as to make the piston rod 16 slidable and an extension-side liquid chamber 40 is formed by means of the piston rod 16 and the piston 18. A guide 42 and a seal member 44 are attached to an outer peripheral surface of the piston 18**.

A second receiving chamber 46 is formed between the partition wall **13*c* and the oil seal 26 and communicates to the contraction-side liquid chamber 30 through the hole 19 bored in the partition wall 13*c***.

The seal member 34 between the cylinder 12 and the first piston 14, the seal member 22 between the cylinder 12 and the partition wall **13*c* and the seal member 44 between the piston rod 16 and the second piston 18 respectively enable liquid to leak through clearances between themselves and movable members. Namely, the seal members 34, 22 and 44 are formed so as to leak a small amount of liquid respectively through clearances between the seal member 34 and the cylinder 12, between the seal member 22 and the piston rod 16 and between the seal member 44 and the piston rod 16. Thus, liquid leaked from the contraction-side liquid chamber 30 through the seal member 34 is received in the receiving chamber 28 and liquid leaked through the seal member 22 is received in the receiving chamber 46. Further, liquid leaked from the extension-side liquid chamber 40 through the seal member 44 is received in the receiving chamber 28**.

A pipe 50 is connected to a boss 52 provided in the first receiving chamber 28 and extends toward the reservoir tank. A check valve 54 is disposed between the first receiving chamber 28 and the reservoir tank and allows liquid to flow only from the first receiving chamber 28 to the reservoir tank. The check valve 54 is biased so as to close the receiving chamber 28 by a coiled spring 56.

In the embodiment shown, the receiving chamber 28 is directly partitioned by the piston 14 and has its volume changed by the movement of the piston 14. A pipe 58 extends from the receiving chamber 46 to the receiving chamber 28 to send the liquid recovered in the receiving chamber 46 to the receiving chamber 28 through the pipe 58.

Figure 2:
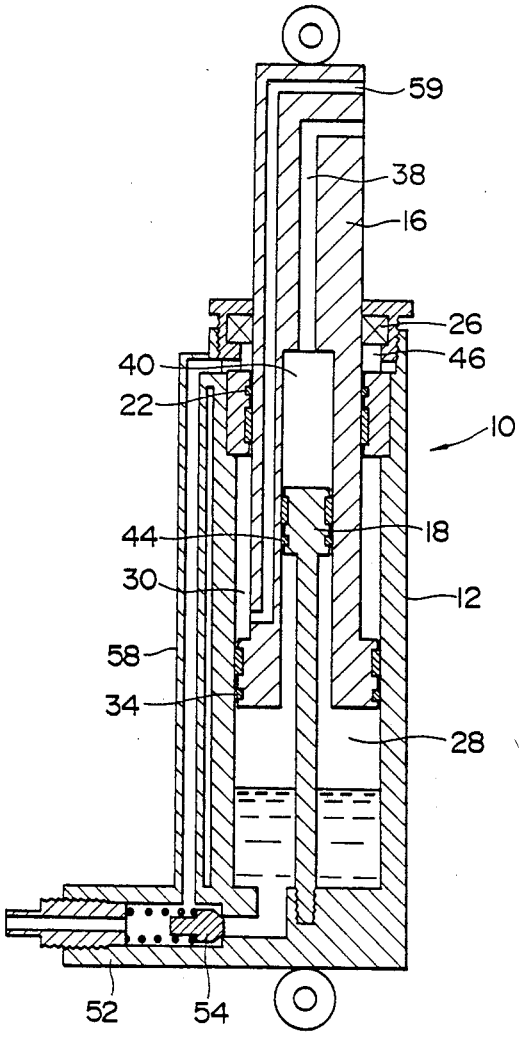
FIG. 2 is a sectional view showing another embodiment of the hydraulic cylinder apparatus.

According to the hydraulic cylinder apparatus 10 shown in FIG. 2, the pipe 58 connected to the receiving chamber 46 is not open to the receiving chamber 28, but is open to the boss 52 at a downstream side of the check valve 54. Thus, since pressure in the receiving chamber 28 does not act on the liquid recovered in the receiving chamber 46, pressure exerted on the oil seal 26 becomes equal to an atmospheric pressure, so that frictional force of the oil seal 26 may be reduced. The other elements of the cylinder apparatus shown in FIG. 2 are same as those shown in FIG. 1.

According to the hydraulic cylinder apparatus 10 shown in FIGS. 1 and 2, the piston rod 16 is provided with a hole 59 opening to the contraction-side liquid chamber 30 on one hand and connected to the external pressure source on the other hand.

Figure 3:
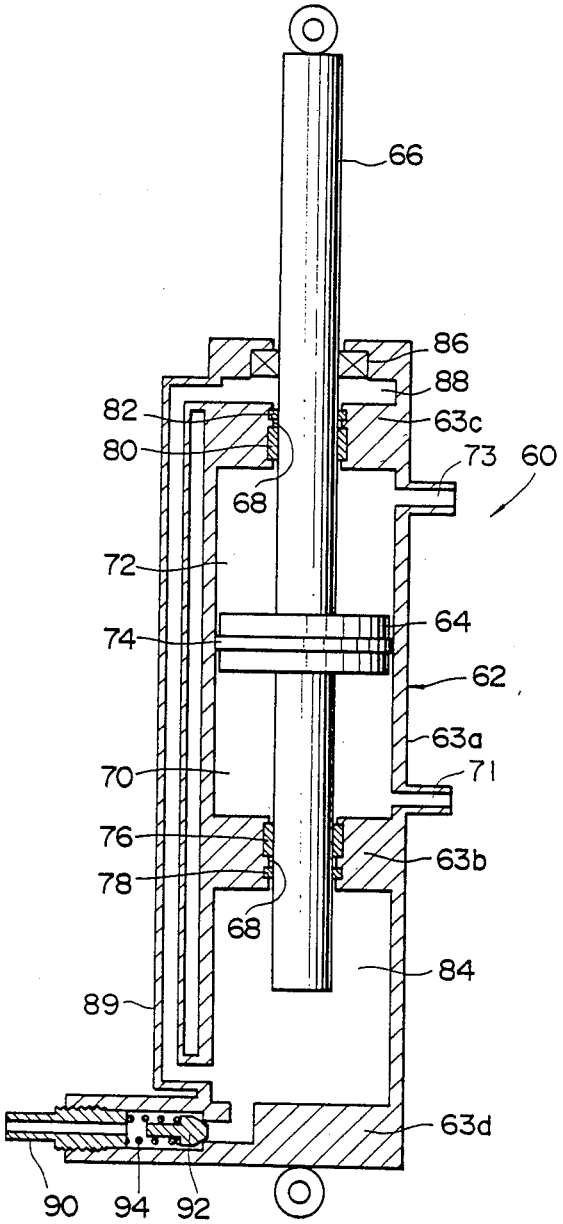
FIG. 3 is a sectional view showing a further embodiment of the hydraulic cylinder apparatus.

A hydraulic cylinder apparatus 60 shown in FIG. 3 comprises a cylinder 62, a piston 64 and a piston rod 66.

The cylinder 62 has a main body 63*a*, two partition walls 63*b*, 63*c* disposed axially and spaced apart from each other and a bottom wall 63*d* spaced apart from the lower partition wall 63*b*. Holes 68 extending axially are bored in the partition walls 63*b*, 63*c* respectively.

The piston 64 is disposed slidably in the cylinder 62 between the partition walls 63*b*, 63*c* to partition the interior of the cylinder 62 into an extension-side liquid chamber 70 and a contraction-side liquid chamber 72. Both liquid chambers 70 and 72 are respectively connected to the external pressure source through respective openings 71 and 73. A seal member 74 is attached to an outer peripheral surface of the piston 64.

The piston rod 66 extends through the holes 68 bored in the partition walls 63*b*, 63*c* and is formed on an intermediate portion thereof integrally with the piston 64. A rod guide 76 and a seal member 78 are disposed between the piston rod 66 and the partition wall 63*b*, and a rod guide 80 and a seal member 82 are disposed between the piston rod 66 and the partition wall 63*c*.

Liquid may leak through clearances between the seal members 74,78 and 82 and movable parts disposed opposedly thereto. Namely, the seal members 74,78 and 82 are formed so as to leak a small amount of liquid through respective clearances between the seal member 74 and the cylinder 62, between the seal member 78 and the piston rod 66 and between the seal member 82 and the piston rod 66.

A space between the partition wall 63*b* and the bottom wall 63*d* is formed as a receiving chamber 84 which communicates to the extension-side liquid chamber 70 through the hole 68 bored in the partition wall 63*b*. Further, a space between the partition wall 63*c* and an oil seal 86 is formed as a receiving chamber 88 which communicates to the contraction-side liquid chamber 72 through the hole 68 bored in the partition wall 63*c* on one hand and to the receiving chamber 84 through a pipe 89 on the other hand. An end of the piston rod 66 extends to the receiving chamber 84 and the volume of the receiving chamber 84 is varied with the movement of the piston rod 66. Liquid leaked through the seal member 74 enters the extension-side liquid chamber 70 or the contraction-side liquid chamber 72.

A pipe 90 extends from the receiving chamber 84 to the reservoir tank, and a check valve 92 is disposed between the receiving chamber 84 and the reservoir tank. The check valve 92 is biased toward the receiving chamber 84 by a coiled spring 94 to allow liquid to flow from the receiving chamber 84 only to the reservoir tank.

Figure 4:
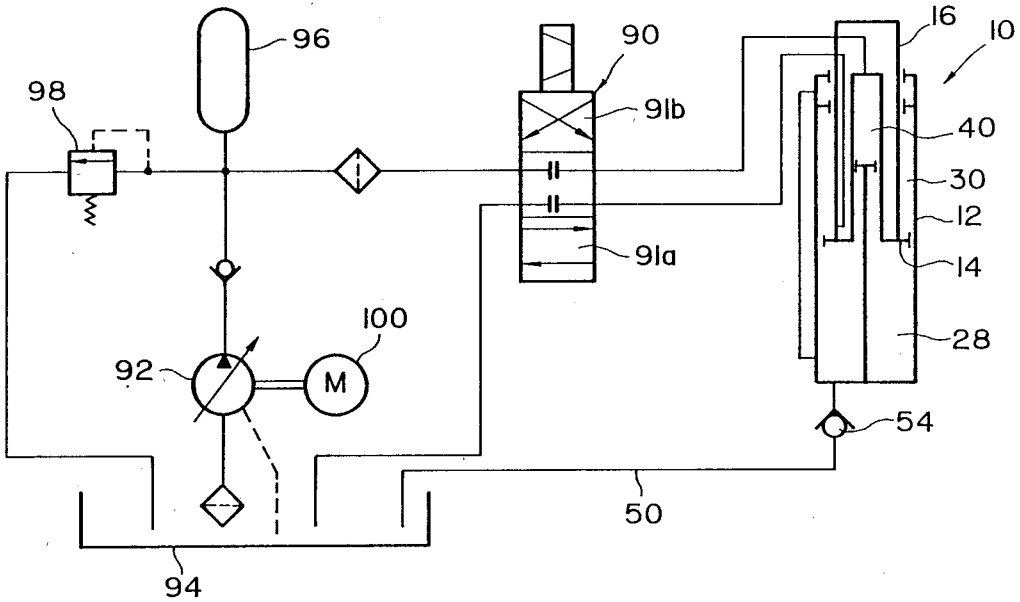
FIG. 4 is a circuit diagram showing schematically the apparatus in operation.

In operation, for example as shown in FIG. 4, the hydraulic cylinder apparatus 10 is disposed between a car body and a suspension arm, the holes 38,59 of the piston rod 16 are connected through flexible hoses to a pump 92 via a directional control valve 90 and further the pipe 50 is connected to a reservoir tank 94. An accumulator 96 is disposed between the pump 92 and the directional control valve 90 and a relief valve 98 is connected to a piping, thereby accumulating constant pressure in the accumulator 96.

When an electric motor 100 is operated, the pump 92 is rotated to feed pressurized liquid to the system. The directional control valve 90 is changed over from a neutral position shown in the drawing to an extension-side envelope 91*a* or a contraction-side envelope 91*b* according to external signals. By so doing, the pressurized liquid is introduced to the extension-side liquid chamber 40 or the contraction-side liquid chamber 30 to extend or contract the piston rod 16. Simultaneously, a slight amount of liquid is leaked from the respective chambers and then received in the receiving chamber 28.

When the piston rod 16 is contracted, the volume of the receiving chamber 28 is compressed by the piston 14. At this time, air pressure in the receiving chamber is increased to open the check valve 54 and the liquid accumulated in the receiving chamber 28 is recovered to the reservoir tank 94. When the liquid in the receiving chamber 28 is returned to the reservoir tank 94, pressure in the receiving chamber is reduced to close the check valve 54.

Reversely, when the piston rod 16 is extended, pressure in the receiving chamber 28 is reduced. At this time, the reverse flow of liquid from the reservoir tank 94 to the receiving chamber 28 is stopped according to the action of the check valve 54.

When the piston rod 16 is not extended and contracted for a long period of time, the extension and contraction-side liquid chambers 40,30 are filled with high pressure fluid, so that liquid leakage takes place to successively increase the amount of liquid accumulated in the receiving chamber 28. Accordingly, air is successively compressed to open the check valve 54 and liquid is recovered to the reservoir tank 94.

What is claimed is:

1. A hydraulic cylinder apparatus which is used by connecting an external pressure source with extension- and contraction-side liquid chambers defined by a cylinder, a piston sliding in the cylinder and a piston rod integral with the piston, comprising:

seal members provided with said extension- and contraction-side liquid chambers respectively and formed to enable liquid to leak through clearances between the seal members and the parts disposed opposite to the seal members;

a first receiving chamber connected to a reservoir tank for receiving liquid leaked from at least one of said extension and contraction-side liquid chambers, the receiving chamber being formed so as to change its volume with the movement of said piston rod;

a second receiving chamber for receiving liquid leaked from said contraction-side liquid chamber; and a check valve disposed between said first receiving chamber and the reservoir tank to allow liquid to flow from the first receiving chamber and to the reservoir tank;

wherein said piston rod extends through the second receiving chamber and projects outwardly of the cylinder apparatus through a seal means for preventing liquid from leaking from the cylinder, and wherein said second receiving chamber is connected to piping to the reservoir tank at a downstream side of the check valve.

2. A hydraulic cylinder apparatus as claimed in claim 1, wherein the apparatus is installed between the body and a suspension arm of an automobile.

3. A hydraulic cylinder apparatus comprising:

a cylinder having a bottom wall and a partition wall axially spaced apart from the bottom wall and provided with a hole extending axially;

a first piston disposed slidably in said cylinder between said bottom and partition walls to partition the interior of said cylinder into a first receiving chamber at the bottom wall side and a contraction-side liquid chamber;

a piston rod integral with said piston extending through the hole bored in said partition wall and having a bore hole extending axially from an end face of said piston;

a second piston fixed to said bottom wall and inserted into the bore hole of said piston rod to form an extension-side liquid chamber together with the piston rod, the piston rod being capable of sliding relatively to the second piston;

a second receiving chamber communicating to said contraction-side liquid chamber through the hole bored in said partition wall;

a first seal member disposed between said piston rod and said partition wall, and second and third seal members disposed respectively between the cylinder and the first piston and between the piston rod and the second piston, the first seal member and at least one of the second and third seal members being formed to enable liquid to leak through clearances between the seal members and the parts disposed opposite to the seal members;

means for connecting said first receiving chamber to a reservoir tank; and a check valve disposed between said first receiving chamber and said reservoir tank to allow liquid to flow from the first receiving chamber to the reservoir tank;

wherein said contraction and extension-side liquid chambers are connected to an external pressure source when in use, and wherein the volume of said first receiving chamber is varied by the first piston, and wherein said piston rod extends through the second receiving chamber and projects outwardly of the cylinder through a seal means for preventing liquid from leaking from the cylinder, and wherein said second receiving chamber is connected to piping to the reservoir tank at a downstream side of the check valve.

4. A hydraulic cylinder apparatus as claimed in claim 3, wherein said piston rod has two holes communicating respectively to the contraction and extension-side liquid chambers and connected to the external pressure source.

* * * * *